United States Patent [19]

Moore

[11] Patent Number: 4,979,308

[45] Date of Patent: Dec. 25, 1990

[54] CAN OPENER AND NIGHT LIGHT APPLIANCE

[75] Inventor: Joseph F. Moore, Richmond, Va.

[73] Assignee: Proctor-Silex, Inc., Glen Allen, Va.

[21] Appl. No.: 378,418

[22] Filed: Jul. 11, 1989

[51] Int. Cl.[5] ..... B67B 7/00; B67B 7/40; H05B 37/02

[52] U.S. Cl. ..... 30/400; 30/405; 315/149

[58] Field of Search ..... 30/400, 401, 403, 404, 30/405, 424, 406; 315/149

[56] References Cited

U.S. PATENT DOCUMENTS

| | | | |
|---|---|---|---|
| 2,867,865 | 1/1959 | Ryan et al. . | |
| 3,081,538 | 3/1963 | Ford . | |
| 3,097,427 | 7/1963 | Croteau et al. . | |
| 3,288,044 | 11/1966 | Bramer | 315/149 |
| 3,492,529 | 1/1970 | McKee | 315/149 |
| 3,946,485 | 3/1976 | McLean | 30/404 |
| 4,561,182 | 12/1985 | Yamamoto et al. | 30/404 |
| 4,695,769 | 9/1987 | Schweickardt | 315/149 |
| 4,860,455 | 8/1989 | Conneally | 30/405 |

OTHER PUBLICATIONS

Black & Decker Model ECL80 Use and Care Book, copyright 1985.

Prior use described in supplement information disclosure statement filed herewith.

*Primary Examiner*—Douglas D. Watts
*Assistant Examiner*—Paul M. Hayrana
*Attorney, Agent, or Firm*—Roger S. Dybvig

[57] ABSTRACT

An under-the-cabinet kitchen appliance functions as an automatic electric can opener and an automatic night light. The appliance includes a housing for the automatic electric can opener integral with a night light bulb housing. The electric circuit for the night light and the can opener are integrated and may include light responsive device so that the light bulb is energized during periods of low room illumination and deenergized during periods of high room illumination.

6 Claims, 1 Drawing Sheet

CAN OPENER AND NIGHT LIGHT APPLIANCE

SUMMARY OF THE INVENTION

The present invention relates to a can opener and night light appliance and is primarily concerned with providing an under-the-cabinet, household kitchen appliance comprising an automatic electric can opener and a night light.

Benefits of night lights and of electrically-operated, household kitchen appliances are well recognized. For several years there has been an increasing trend toward the use of under-the-cabinet household appliances. These have the advantage of not occupying counter or storage space. They are also relatively permanent installations.

This invention provides an under-the-cabinet kitchen appliance comprising an automatic electric can opener and an integral night light so that the night light is advantageously located between a kitchen counter and a kitchen cabinet. Because of the permanency and location of under-the-cabinet installations, the night light will always be in one place, conveniently located to illuminate the kitchen. Accordingly, the combined advantages of an under-the-cabinet electrically-operated can opener and of a night light are obtained without requiring separate appliances or separate electrical outlets.

An object of this invention is to provide a kitchen appliance comprising an electric can opener and a night light which can be energized during periods of low room illumination and deenergized during periods of high room illumination.

Another object of this invention is to provide such an appliance wherein the night light is connected in the same electric circuit as the electrically-operated parts of the can opener.

In accordance with this invention, a housing for a night light bulb is integrally formed with the housing of an automatic electric can opener and the controlling electric circuit for the can opener and the night light are integrated. In the preferred embodiment of this invention, the electric circuit for the night light includes light-responsive means, preferably a photoconductive transducer, exposed through the can opener housing so that the night light is automatically energized during periods of low ambient room illumination and automatically deenergized during periods of high ambient room illumination.

This invention primarily contemplates combining the structure and functions of an under-the-counter electric can opener and a night light into a single appliance because an under-the-counter electric can opener would normally be connected to house current all of the time. Further, an automatic electric can opener need not have a separate power switch which could disable the operation of the night light.

Other objects and advantages will become apparent from the following description and the drawing.

DETAILED DESCRIPTION

Figure 1:
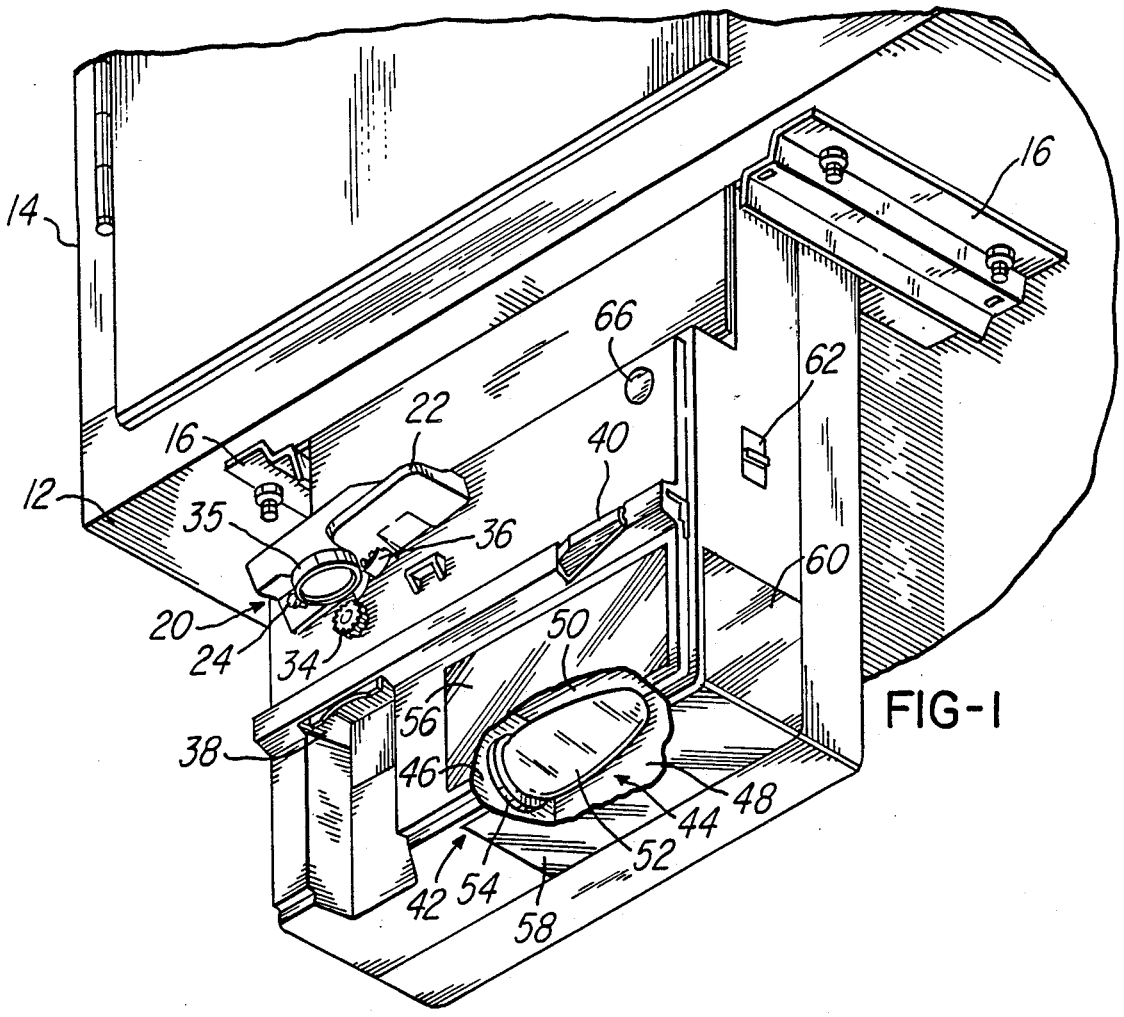
FIG. 1 is a perspective view of a household kitchen appliance in accordance with this invention.

Referring to FIG. 1, reference number 10 is used to generally designate a household kitchen appliance, made in accordance with this invention constructed and operational as both an automatic electric can opener and a night light. The appliance 10 is of the type known as an "under-the cabinet" appliance because it is suspended from the bottom wall 12 of a cabinet 14 by brackets 16 and extends downwardly therefrom in perpendicular relation to the bottom wall 12.

Figure 2:
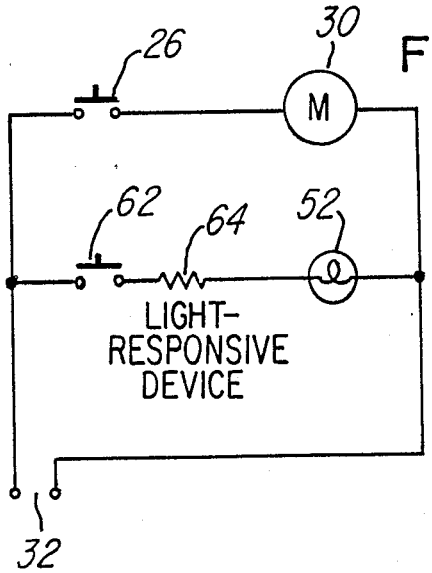
FIG. 2 is a schematic view of the electric circuit of the appliance of FIG. 1.

The appliance 10 comprises a generally rectangular housing 18 for enclosing the circuitry and mounting the components required for the can opener functions and the night light functions. The can opener structure comprises an automatic knife assembly, generally designated 20, which may be of conventional construction. The illustrated automatic knife assembly 20 comprises a switch-actuating arm 22 that may be manually rotated about a pivot pin 24 against the bias of a spring means (not shown) to close a normally open motor-controlling switch 26 (FIG. 2) located within the housing 18 and forming part of a can opener drive motor-controlling electric circuit generally designated 28. Upon closure of the motor-controlling switch 26, an electric drive motor 30 (FIG. 2), also mounted within the housing 18, is connected to a source of house current by a conventional plug 32. The motor 30 rotatably drives a drive wheel 34 (FIG. 1) engageable with a bead on the rim of a can (not shown) to be opened to thereby rotate the can.

In the operation of the can opener mechanism shown in FIG. 1, upon initial rotation of the can to be opened, a cutting knife 36 is caused to pivot into and thus pierce the lid of the can. A reaction force between the cutting knife 36 and the can lid holds down the actuating arm 22 to thereby maintain the switch 26 closed so that the drive motor 30 continues to operate to rotate the can whereupon the cutting knife 36 cuts an opening in the can lid. After the can has rotated one full revolution, the can lid thereby being fully opened, the cutting knife 36 no longer encounters the resistance of the can lid and the switch operating arm 22 returns under the bias of the aforementioned spring means to open the motor-controlling switch 26 whereupon the drive motor 30 is deenergized. During and after the operation of the can opener mechanism, a lid magnet 35 carried by the switch-actuating arm 22 is brought into and maintains contact with the center of the can lid, allowing easy removal of the opened can. Since the details of the construction and operation of the can opener mechanism may be entirely conventional and are unimportant for purposes of the present invention, they are not further disclosed herein. Various different automatic can opener mechanisms may be used with this invention. Among several patents showing such mechanisms U.S. Pat. No. 3,675,321, granted July 11, 1972, to Arel et al.

Other features associated with the illustrated housing 18 include a bottle opener 38 and a bag splitter 40. These are optional for use with this invention and are common in prior can opener constructions.

In accordance with this invention, a night light assembly, generally designated 42, is integrated into the housing 18 and into the drive motor-controlling circuitry of the can opener. To this end, a night light bulb-receiving compartment 44 is formed in the lower right side portion of the housing 18. Compartment 44 is of a rectangular box-like configuration, having interior walls, which may be coated with a light-reflective material, including an inner end wall 46, a rear wall 48, and a top wall 50. A light bulb 52 is located within a light socket 54 mounted in the end wall 46. The compartment 44 is closed by outer, translucent or transparent wall panels comprising a front wall panel 56, a bottom wall panel 58, and an outer end wall panel 60. Other arrangements and locations of the night light bulb-receiving compartment 44 could, of course, be used.

With reference again to FIG. 2, an electric circuit for controlling the operation of the night light bulb 52 is mounted in the housing 18 and preferably comprises an on/off power switch 62 in series with the socket contacts (schematically represented by the bulb 52 in FIG. 2) and a suitable light-responsive device 64 for controlling the operation of the light bulb 52 when the on/off power switch 62 is closed. The light-responsive device 64 preferably comprises a photoconductive transducer exposed to ambient light through a lens 66 mounted in the front wall of the housing 18 behind which the transducer 64 is located. The resistance of the transducer 64 varies with the intensity of ambient light so that, during periods of low room illumination, the electric resistance through transducer 64 will be lower than it is during periods of greater room illumination. In this way, the light emitted by the night light bulb 52 increases in intensity as the room darkens. During periods of high ambient light, the electric resistance through transducer 64 increases, thereby decreasing the intensity of the light emitted by the night light bulb 52 to the point that little or no light is emitted.

The light power switch 62 is optionally provided to enable the owner of the appliance 10 to activate or deactivate the night light circuit. It is conveniently accessible for manual operation on one side of the housing 18.

Although the light-responsive device 64 preferably comprises a photoconductive transducer, it could be a light-activated switch. During periods of low room light illumination, the light-activated switch would be closed, allowing the night light to be energized to a constant level of brightness. During periods of greater room illumination, the light-activated switch would open, thereby causing the night light to be deenergized.

It may be observed that the can opener circuit components, namely the drive motor 30 and the motor-controlling switch 26 are series connected and the night light circuit components, namely the bulb 52, the light responsive device 64, and the light power switch 62 are series connected in a series circuit that is parallel to the can opener circuit components. Accordingly, the opening of a switch in one of the series circuits does not disable the operation of the other series circuit. The appliance 10 may remain plugged to house current all of the time to enable proper operation at all times of both the can opener mechanism as well as the night light assembly.

Although the presently preferred embodiment of this invention has been described, it will be understood that within the purview of this invention various changes may be made within the scope of the following claims.

I claim:

1. An electrically-operated, under-the-cabinet household kitchen appliance comprising a housing, a can opener assembly mounted on said housing, and a night light assembly comprising a light bulb within said housing, said housing including transparent or translucent panel means partly enclosing said light bulb, an electric drive motor for said can opener within said housing, electric circuit means within said housing connected to said drive motor for controlling the operation thereof, and connected to said light bulb for controlling the operation thereof, said electric circuit means comprising light-responsive means exposed through said housing for controlling the operation of said night light bulb in accordance with the ambient light level.

2. The appliance of claim 1 wherein said light-responsive means comprises a photoconductive transducer in series with said light bulb.

3. The appliance of claim 2 wherein said photoconductive transducer and said light bulb are in electrical parallel circuit relation to said drive motor.

4. The appliance of claim 1 wherein said light-responsive means comprises a light-activated switch in series with said light bulb.

5. The appliance of claim 1 wherein said electric circuit means further includes a manually operable power switch for connecting or disconnecting power to said light responsive device and said light bulb.

6. The appliance of claim 5 wherein said power switch, said light responsive device, and said light bulb contacts are in a series circuit arranged in electrical parallel to said drive motor.

* * * * *